US005860804A

United States Patent [19]

Nachaj

[11] Patent Number: 5,860,804

[45] Date of Patent: Jan. 19, 1999

[54] BAFFLE IGNITOR ASSEMBLY

[75] Inventor: Henry S. F. Nachaj, Kirkland, Canada

[73] Assignee: Société en Commandite Gaz Metropolitain, Montreal, Canada

[21] Appl. No.: 961,367

[22] Filed: Oct. 30, 1997

[51] Int. Cl.[6] ..... F23Q 7/00

[52] U.S. Cl. ..... 431/263; 431/264

[58] Field of Search ..... 431/263, 264, 431/258; 60/39.822, 39.827, 39.828; 123/145 A, 169 PA

[56] References Cited

U.S. PATENT DOCUMENTS

| | | | |
|---|---|---|---|
| 1,293,520 | 2/1919 | Nolte et al. . | |
| 1,646,503 | 10/1927 | Steward | 431/263 |
| 1,914,284 | 6/1933 | Palmer . | |
| 1,956,586 | 5/1934 | Palmer . | |
| 3,823,345 | 7/1974 | Mitts et al. | 431/263 |
| 4,266,930 | 5/1981 | Leonard et al. | 431/263 |
| 4,359,977 | 11/1982 | Spencer et al. | 123/145 A |
| 4,818,219 | 4/1989 | Widermann et al. | 431/263 |
| 4,941,817 | 7/1990 | Schlosser | 431/263 |
| 5,182,437 | 1/1993 | Schmid et al. | 123/145 A |
| 5,216,990 | 6/1993 | Moosemann et al. | 123/145 A |

*Primary Examiner*—Carl D. Price
*Attorney, Agent, or Firm*—Carter & Schnedler, P.A.

[57] ABSTRACT

A baffle ignitor assembly (1)) comprises an ignitor element (12) which is located in a cylindrical baffle (14). The cylindrical baffle (14) has an elongated opening (15) in a sidewall (17) thereof and which opening is dimensioned to admit a gas/air mixture flow from a burner nozzle (11) when positioned in close proximity thereof and at a desired orientation with respect thereto. An orifice (16) is provided in the sidewall (17) opposite the opening (15) and together with the opening creating a stable slightly turbulent low velocity air/gas flow mixture (25) in the baffle (14) about the ignitor element (12) for ignition of the air/gas mixture.

8 Claims, 1 Drawing Sheet

BAFFLE IGNITOR ASSEMBLY

TECHNICAL FIELD

The present invention relates to a baffle ignitor and wherein an ignitor element is located inside an elongated cylindrical baffle shield.

BACKGROUND ART

Various problems exist with gas burner ignitors. With small capacity burners in the range of 50 to 250,000 btu per hour, the gas from the burner nozzle mixes with exterior air to form an air/gas mixture which is directed against an ignitor element, such as a hot surface ignitor which is usually heated to a temperature of about 2300° F. Because exterior air is often cool, the hot surface of the ignitor is cooled by this exterior air and it therefore takes more time for the element to reach its ignition temperature.

Several methods are used to insure ignition.

A) The entire ignition sequence is restarted including pre and post purge. This slowly heats the local ignition area to facilitate ignition. Unfortunately, if ignition still does not take place, a manual reset or a shutdown is initiated by the burner control. This method wastes electrical and gas energy and can lead to service calls that have to be charged to the user.

B) After the standard pre-purge of the combustion chamber, the fan is stopped. The gas valve slowly opens. Since there is no air circulation, a controlled explosion is initiated and the fan restarts when a flame is detected and then the gas valve fully opens. This controlled explosion generates a sound that is audible outside as well as near the unit. The explosion makes a sound which causes an inconvenience to the users as they perceive that the burner is malfunctioning and that there might be danger of explosion. To control this problem fans are used to purge the combustion gas when ignition does to take place. This necessitates the use of controls to cycle the fans and the gas valve.

With larger burners having capacities of 250,000 to 400,000 btu and above, the use of a modulator system is employed whereby to modulate the air to create small volumes of gas/air mixture which increases slowly. Such systems utilize modulating gas valves or step gas valves as well as variable speed air supplies and complex electronic ignition controls. Other system use a pilot that is ignited intermittently or continuously to ensure main burner ignition. Like the cold air problem the high volume of air-gas in the mixture and its velocity cools the ignitor element or the spark does not have sufficient time to be in contact with the gas-air mixture and thus ignition is not possible or instantaneous. The result is usually a restart of the ignition protocol: pre-purge, actuate ignition (hot surface or spark), open gas valve, check for flame, fully open gas valve or if no flame is detected, post purge and repeat the sequence.

SUMMARY OF INVENTION

It is a feature of the present invention to provide a baffle ignitor assembly which substantially overcomes the above-mentioned disadvantages of the prior art.

Another feature of the present invention is to provide a baffle ignitor assembly which comprises an ignitor element located within a cylindrical baffle shield which is provided with an opening therein which is disposed at a desired orientation in close proximity to a burner nozzle to admit a gas/air mixture therein and wherein an orifice is provided opposite the opening and which together with the opening creates a turbulent air/gas flow mixture in the baffle about the ignitor.

According to the above features, from a broad aspect, the present invention provides a baffle ignitor assembly which comprises an ignitor element having contact means to connect an electrical current thereto. A cylindrical baffle shield surrounds the element and has opening means in a sidewall thereof which is dimensioned to admit a gas/air mixture stream from a burner nozzle when positioned in close proximity thereof and at a desired orientation with respect thereto. An orifice is provided in the sidewall opposite the opening which together with the opening creates a stable, low velocity shielded air/gas flow mixture in the baffle about the ignitor element for ignition of the air/gas mixture.

BRIEF DESCRIPTION OF DRAWINGS

A preferred embodiment of the present invention will now be described with reference to the accompanying drawings in which.

DESCRIPTION OF PREFERRED EMBODIMENTS

Figure 1:
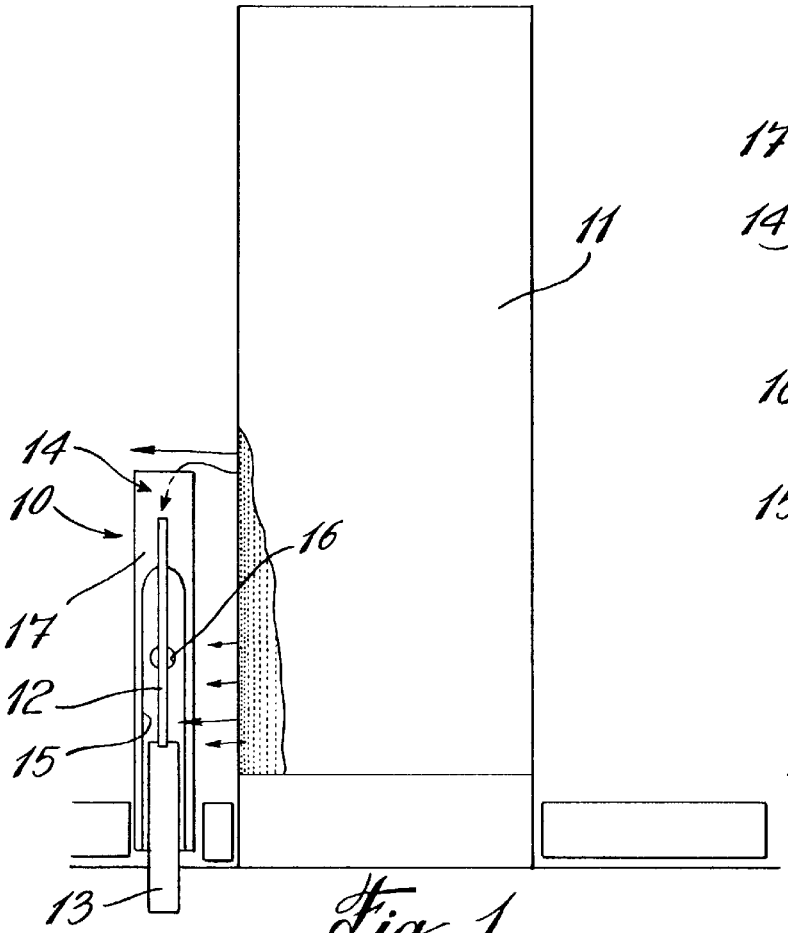
FIG. 1 is a side view illustrating the baffle ignitor assembly of the present invention secured adjacent a burner nozzle.

Referring now to the drawings and more particularly to FIG. 1, there is shown at 10 the baffle ignitor assembly of the present invention. As hereinshown the assembly is disposed at a predetermined location adjacent a burner nozzle 11 which is commonly used in domestic or commercial heaters. As hereinshown the baffle ignitor assembly 10 is comprised of an ignitor element 12, herein a hot surface ignitor element which is provided with a contact 13 directly connected to a suitable power supply to provide current to the ignitor element 12 whereby to heat it to approximately 2300° F. to ignite the air/gas mixture provided thereto and as will be described later.

Figure 2:
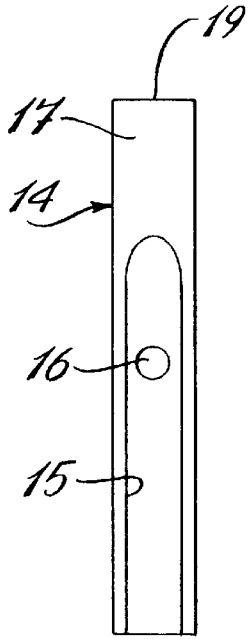
FIG. 2 is a side view of the baffle ignitor assembly illustrating the positions of the opening and the orifice provided in the cylindrical sidewall of the baffle.
Figure 3:
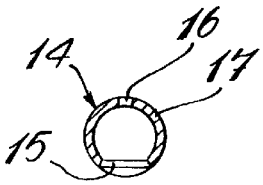
FIG. 3 is a top view of FIG. 2.

With additional reference to FIGS. 2 and 3, it can be seen that a cylindrical baffle 14, herein constituted by an elongated open top end cylindrical tube of circular cross-section and constructed of stainless steel, surrounds the ignitor element 12 whereby to shield this element against excessive cool air currents or high velocity movement produced by fans and the burner nozzle when turned on. The air and gas flow, at the outset, have a tendency to cool the ignitor element to restart the ignition protocol or produce a small explosion in the vicinity of the burner nozzle which produces an inconvenient sound, as previously described. As shown in FIG. 2 the cylindrical baffle is provided with an elongated opening 15 which extends longitudinally of the cylindrical baffle 14 and which exposes at least a portion of the ignitor element 12. A small orifice 16, herein shown as being a circular orifice, is provided in the sidewall 17 of the cylindrical baffle 14 and disposed opposite to the opening 15 and the ignitor element 12.

It is pointed out that the cylindrical baffle 14 may be of different workable cross-section and may also be constructed of other suitable materials such as ceramics or any other capable of withstanding the high temperature flame produced by the burner nozzle 11. Furthermore, although FIG. 1 illustrates the use of a hot surface ignitor element 12, other types of ignitors such as electronic or electric ignitors may be provided.

Figure 4:
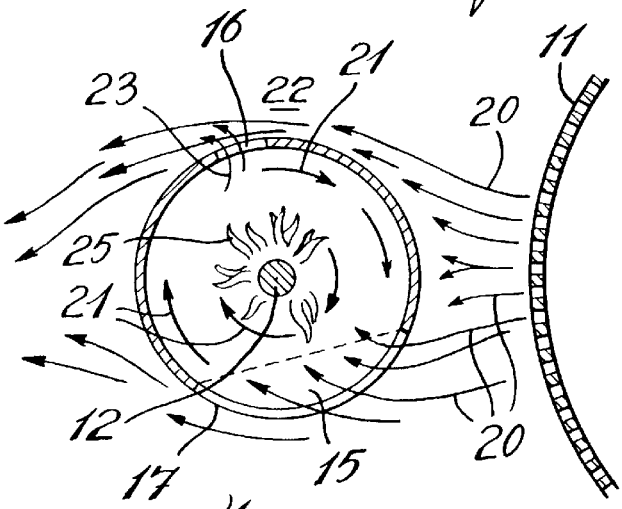
FIG. 4 is a schematic view showing the position of the openings relative to a burner nozzle and the air/gas feed within the cylindrical baffle.

With reference now to FIG. 4 there will be described the operation of the baffle ignitor assembly 10. As hereinshown, and as previously described, the baffle ignitor assembly 10 is mounted adjacent the burner nozzle 11 and extends substantially parallel thereto. The opening 15 is oriented offset at an angle to the burner nozzle as herein illustrated, whereby the pressurized gas streams 20, which radiate from the burner nozzle 11 substantially at right angles thereto, will enter the elongated opening tangentially. This causes the gas and air mixture to spiral within the cylindrical baffle 14 as illustrated by arrows 21. This in turn causes a turbulent high pressure area. This pressure is partially released by orifice 16. The result of this release of pressure creates a small negative pressure area at the opening 19. The air-gas mixture within the baffle is very stable, in a very low velocity field. Simultaneously the gas streams 20 which are released against the cylindrical baffle sidewall 17 cause a high pressure in the region 22 opposite the opening 15 and this causes air and gas mixture to be expelled from the orifice 16, as shown by arrows 23 and create a small turbulence with the spiraling gas about the ignitor element 12. The heat from the ignitor warms the mixture and produces a small area of ignition which slowly extends to the main burner. The shielding effect of the baffle cylinder causes the air/gas mixture in the vicinity of the ignitor to immediately ignite to produce an ignition flame 25 at the top opening 15 and 19 to ignite the burner 11. Immediately after the burner flame is detected, the ignitor element 10 is shut off.

It is within the ambit of the present invention to cover any obvious modifications of the preferred embodiment described herein, provided such modifications fall within the scope of the appended claims.

I claim:

1. A baffle ignitor assembly comprising an ignitor element, means to connect a power supply to said ignitor element, a cylindrical baffle shielding said element, said cylindrical baffle being an elongated tube having a cylindrical sidewall of circular cross-section and having an open top end at which an ignition flame is produced, an elongated opening disposed axially in said sidewall adjacent at least a portion of said ignitor element and dimensioned to admit a gas/air mixture stream from a burner nozzle when said cylindrical baffle is positioned in close proximity to a burner nozzle and oriented offset at an angle to a pressurized gas stream radiating from said burner nozzle, said elongated tube extending substantially at right angle to said pressurized gas stream, said elongated opening causing an air/gas flow mixture to spiral within said cylindrical baffle, and an orifice in said sidewall opposite said elongated opening and adjacent said ignitor, said orifice being a hole much smaller than said elongated opening and dimensioned to release pressure within said baffle thereby creating a negative pressure at said small hole and a turbulence about said ignitor element for ignition of said air/gas mixture therein to produce said ignition flame.

2. A baffle ignitor assembly as claimed in claim 1 wherein said elongated tube is constructed of stainless steel which is capable of withstanding a high temperature flame.

3. A baffle ignitor assembly as claimed in claim 1 wherein said small hole is a circular hole disposed adjacent said elongated opening and spaced lower than a top end of said elongated opening, said ignitor element being disposed in said elongated tube between said circular hole and said elongated opening.

4. A baffle ignitor assembly as claimed in claim 3 wherein said ignitor element is a hot surface ignitor element which is disposed substantially along a central longitudinal axis of said cylindrical baffle.

5. A baffle ignitor assembly as claimed in claim 3 wherein said ignitor element is an electronic spark ignitor element.

6. A baffle ignitor assembly as claimed in claim 3 in combination with a burner nozzle, said baffle ignitor assembly being secured in close proximity and extending longitudinally and substantially parallel to said burner nozzle, and elongated opening facing said burner nozzle at said offset angle whereby some pressurized gas released from said nozzle in a stream will mix with air and enter said elongated opening tangentially to create said spiral air/gas flow therein which will pass about said ignitor element to ignite and rise in said elongated tube to create an ignition flame at said open top end.

7. A baffle ignitor assembly as claimed in claim 1 wherein said elongated tube is constructed of ceramic materials which is capable of withstanding a high temperature flame.

8. A baffle ignitor assembly as claimed in 3 wherein said ignitor element is an electric spark ignitor element.

* * * * *